US012134899B2

(12) United States Patent
Cavender

(10) Patent No.: US 12,134,899 B2
(45) Date of Patent: Nov. 5, 2024

(54) RIGID FOAM, CONTINUOUS RAISED FLOOR STRUCTURE WITHOUT WOODEN SUPPORTS

(71) Applicant: ISOSTRUC LLC, Mint Hill, NC (US)

(72) Inventor: Stephen Edward Cavender, Mint Hill, NC (US)

(73) Assignee: ISOSTRUC LLC, Mint Hill, NC (US)

( * ) Notice: Subject to any disclaimer, the term of this patent is extended or adjusted under 35 U.S.C. 154(b) by 30 days.

(21) Appl. No.: 18/095,342

(22) Filed: Jan. 10, 2023

(65) Prior Publication Data

US 2023/0220682 A1 Jul. 13, 2023

Related U.S. Application Data

(60) Provisional application No. 63/298,505, filed on Jan. 11, 2022.

(51) Int. Cl.

| | |
|---|---|
| ***E04F 15/024*** | (2006.01) |
| ***E02D 27/01*** | (2006.01) |
| ***E04B 1/00*** | (2006.01) |
| ***E04B 5/02*** | (2006.01) |
| ***E04C 3/29*** | (2006.01) |
| ***E04F 15/10*** | (2006.01) |

(52) U.S. Cl.

CPC ..... *E04F 15/02452* (2013.01); *E02D 27/01* (2013.01); *E04B 1/0007* (2013.01); *E04B 5/026* (2013.01); *E04C 3/29* (2013.01); *E04F 15/02458* (2013.01); *E04F 15/107* (2013.01); *E04F 2290/02* (2013.01)

(58) Field of Classification Search

CPC ..... E04F 15/02452; E04F 15/107; E04F 2290/02; E04F 15/02405; E04F 15/02411; E04F 15/02447; E04F 15/02458; E02D 27/01; E04B 1/0007; E04B 1/644; E04B 5/026; E04C 3/28; E04C 3/29

USPC ..... 52/292, 293.1, 293.2, 293.3, 403.1

See application file for complete search history.

(56) References Cited

U.S. PATENT DOCUMENTS

| | | | | |
|---|---|---|---|---|
| 3,339,326 A * | 9/1967 | Derr | F16L 59/029 | 52/309.3 |
| 3,529,393 A | 9/1970 | Wilkins | 52/731 | |
| 4,001,474 A * | 1/1977 | Hereth | E04C 2/3405 | 428/116 |
| 4,223,053 A * | 9/1980 | Brogan | B29D 24/008 | 428/36.1 |
| 4,416,097 A * | 11/1983 | Weir | E04C 2/40 | 52/270 |

(Continued)

FOREIGN PATENT DOCUMENTS

| | | | |
|---|---|---|---|
| DE | 1609574 | 4/1970 | E04C 2/36 |
| WO | WO9606242 | 2/1996 | E04B 2/00 |
| WO | WO0235026 | 5/2002 | E04B 2/16 |

OTHER PUBLICATIONS

European Search Report dated May 12, 2023 issued in related Application Serial No. 23151097.5, 8 pages.

*Primary Examiner* — Brent W Herring

(74) *Attorney, Agent, or Firm* — HAYES SOLOWAY P.C.

(57) ABSTRACT

A building sub-floor construction comprising a plurality of elongated beams formed of rigid polymer foam material, wherein the elongated beams comprise similar cross-sectional shapes, and wherein the elongated beams are configured to snuggly engage one another along their lengths to produce a continuous slab.

9 Claims, 8 Drawing Sheets

(56) References Cited

U.S. PATENT DOCUMENTS 4,903,446 A 2/1990 Richards et al. ..... E04B 1/14
5,353,560 A 10/1994 Heydon ..... E04B 2/00
5,553,430 A 9/1996 Majnaric et al. ..... E04B 2/00
5,671,575 A * 9/1997 Wu ..... E04F 19/0481 52/480
5,678,362 A * 10/1997 Hulls ..... E04B 1/72 52/293.3
5,685,124 A * 11/1997 Jandl, Jr. ..... E04B 5/02 52/783.17
5,732,519 A * 3/1998 Leek ..... E04B 1/0007 52/712
6,023,806 A * 2/2000 Dumlao ..... B63B 5/00 14/77.1
6,145,270 A 11/2000 Hillman ..... E04C 3/02
7,024,831 B1 4/2006 Clark et al. ..... E04C 5/08
7,784,235 B2 * 8/2010 Cretti ..... E04B 5/19 52/332
8,904,737 B2 * 12/2014 Schiffmann ..... E02D 27/013 52/270
9,109,340 B1 * 8/2015 Linn, Jr. ..... E02D 5/223
10,731,341 B2 8/2020 Lambach et al. ..... E04B 5/02
2003/0167710 A1 * 9/2003 Tanase ..... E04F 15/02405 52/220.1
2004/0171710 A1 9/2004 Maechtle et al. ..... C08J 9/00
2006/0254167 A1 * 11/2006 Antonic ..... E04B 1/28 52/293.3
2007/0039269 A1 * 2/2007 Niese ..... E04F 15/22 52/403.1
2010/0300037 A1 12/2010 Turner et al. ..... E04C 3/29
2011/0179728 A1 * 7/2011 Cerny ..... E01C 5/001 52/741.11
2012/0011791 A1 * 1/2012 Lach ..... E04F 15/10 52/309.3
2012/0055108 A1 * 3/2012 Bierwirth ..... E04F 15/182 52/403.1
2013/0000223 A1 * 1/2013 Hill ..... E04B 1/26 52/293.3
2016/0138275 A1 * 5/2016 Cormier ..... E01C 13/045 52/403.1
2018/0347207 A1 * 12/2018 Hayes ..... B32B 7/09
2019/0360216 A1 * 11/2019 Hayes ..... E01C 3/006

* cited by examiner

RIGID FOAM, CONTINUOUS RAISED FLOOR STRUCTURE WITHOUT WOODEN SUPPORTS

CROSS REFERENCE TO RELATED APPLICATION

This application claims priority from U.S. Provisional Application Ser. No. 63/298,505, filed Jan. 11, 2022, the contents of which are incorporated herein by reference.

FIELD OF THE INVENTION

The present invention relates to building construction. The invention has particular utility in connection with building one, two and three story residential building structures and will be described in connection with said utility, although other utilities are contemplated.

BACKGROUND

Wood has been used for millennia and is still the traditional building material for residential home construction. It has been stated that more than 90% of new 1, 2 or 3 story residential homes in the USA are built with wood. They utilize standard dimensional lumber via a stick-built framing system which may be pre-fabricated or built on site. This application accounts for approximately 40 percent of wood consumed in the United States.

Houses generally are based on pored or pre-form concrete or concrete block foundations, but above ground, standard-size lumber, typically made with softwoods, is almost unanimously the product of choice for house framing in the United States. While easy to erect, there are several downsides to the use of wood as a traditional house framing material:

- Wood rot/biodegradation. Wood has a relatively short lifespan and begins to age even before construction begins. Whilst house building starts with the use of new wood its degradation process is already underway. This causes chemical and structural properties to be subsequently compromised.
- Termites and other insects. Softwood, especially when moist, is an attractive food for termites etc. and costly remediation work and maintenance may be required at some point.
- Mold and mildew. This is a concern with wood construction as the hydrophilic nature of wood encourages the proliferation of mold and mildew, abundant spores from which can become a health hazard inside the finished home.
- Fire risk. Builders especially should be aware of the fire hazards in the early stages of construction, when the wood frame is largely exposed. Cloaking it in protective materials, like gypsum wallboard reduces but does not eliminate this hazard.
- Product consistency. Wood is a natural material and exhibits considerable differences even from one cut to the next. Softwoods that are stress-graded are used as beams, posts, studs, rafters, and joists, for example, where the material is functioning in a load-bearing capacity and working stresses will be applied. However, for wood, these stress gradings may be determined only by visual means.
- Deformation. Warping, cracking and splintering are common deformations prior to during and after installation and again lead to compromises in the final structural properties.

- Insulation. Wood is a poor insulator and requires the use of vapor barriers and insulation materials.
- Wear. Floors can become squeaky and springy as the wood and its fastenings weaken.

Increased processing and treatment is required to reduce some of these deficiencies. Notwithstanding the above and other downsides, wood is the predominant building material for residential building construction.

Sustainability, deforestation, averting climate change and energy efficiency are other controversial environmental issues centered around the use of wood for residential building construction.

The International Building Code governing specifications for residential and other construction is designed around wood and to some extent is accommodating towards its structural weaknesses. However, there are situations, such as with taller buildings, where these deficiencies make wood totally unsuitable due to safety concerns.

Concrete is perhaps one of the most heavily relied upon construction materials. Its basic form and composition has been the same for many years, it doesn't warp from humidity or water damage, doesn't attract termites and is non-combustible, and an option to replace wood in some applications.

In some parts of the world, concrete beam and block flooring, also referred to 'rib and block' or 'lintel and block', is utilized. This technique is used to create in-situ, suspended concrete floors in concrete or masonry buildings and has become popular in residential construction. This system incorporates concrete blocks, either solid or hollow supported on a series of parallel, typically pre-cast, pre-stressed concrete beams or ribs. The most common way to achieve this involves inverted T-beams that incorporate continuous ledges on their lower sections that give the blocks full support. Typically, beams are about ten inches-deep and can span up to sixteen feet supported at each end, either on internal load bearing walls or on the perimeter walls, with no sill plates or header joists, held in place mainly by their weight.

With these beams in place and supported at either end, laying the blocks can be performed by hand to fill voids between the parallel beams. Once the filler blocks are installed, a continuous working surface is created upon which further work can take place safely. Often, a sand and cement grout is brushed over the top surface to fill any gaps and prevent insects and vermin from entering, as well as to provide air tightness. Once cured, the topping will allow the floor to take its full working load.

Such floors are very durable and sturdy, but very heavy; the beams even sag under their own weight. Also, they usually require heavy lifting equipment to help get them in place and are not suited for irregular shaped designs as they cannot easily be cut to length. U.S. Pat. No. 7,024,831 to Clark describes a concrete floor system and method of making floor components. As disclosed therein, the concrete floor system includes a plurality of parallel concrete beams infilled with hollow concrete blocks. Substituting steel for the concrete beams suffers from some of the same drawbacks as well as the additional lack of insulation.

Where a very lightweight, insulated, floor slab is required, concrete hollow blocks can be replaced with rigid insulation blocks. These blocks are usually described as encased EPS (Expanded Polystyrene) which has potential flammability issued and is structurally weak, but moderately good for insulation.

Plastics are a fast growing building material as their chemical variety and synthetic versatility allows plastics materials to overcome many shortcomings in other building materials. Plastics materials are being used in place of metals and even concrete in an increasing number of applications. The use of recycled and/or virgin plastic lumber is well suited for outdoor furniture and decks and is currently available nationwide. Here the theme is imitation wood fora "drop-in" replacement product but without the weather accelerated biodegradation issues suffered by wood.

Slab-on-grade, basement, crawlspace, and raised pier are the four types of foundation approaches used in building construction. The basement, crawlspace and pier approaches all serve to elevate the first floor of the structure to an elevation that is at, or above, grade. Although raised floor above crawl spaces have considerably less exposure to the elements than house siding or decks, it would be desirable to replace the use of wood with plastic in this application.

Attempts to replace dimensional lumber in residential raised floor construction have largely been centered on producing plastic imitations with or without incorporation of recycled plastic. With this approach, two main problems occurred: a relatively large amount of plastic was required, making it uneconomical, and creep. In materials science, creep is the tendency of a solid material to move slowly or deform permanently under the influence of persistent mechanical stresses. It can occur as a result of long-term exposure to high levels of stress even though they are still below the yield strength of the material.

Plastics can be extruded or molded into intricate shapes whereas wood for house building essentially is only available as dimensional lumber. Plastics can be formulated from very rigid to very flexible, elastomeric pieces. Rigid plastics resist creep although they tend to be harder to fasten with nails or screws. Plastics can be foamed for significant reduction in weight, making them easier to handle, as well as lowering cost. They also can include a fire retardant to make them self-extinguishing when a source of ignition is removed.

Urethane polymers or polyurethanes are a large family of polymers with widely varying properties and uses. Polyurethane, often abbreviated to PUR, is a polymer composed of multiple organic units joined by chemical urethane links. These urethane links are formed by the reaction of an isocyanate with an alcohol. When both the isocyanate and alcohol contain two or more functional groups per molecule, such as with di- or tri-isocyanates and polyols, they react to produce polyurethanes.

Isocyanates also may react with water, often included in the polyol portion, forming carbon dioxide gas, which can be utilized through the assistance of foam stabilizers, to produce foams. In many cases, a low-boiling liquid, such as a pentane, methylene chloride, or a hydrofluoro olefin (HFO), also may be added to the polyol component to provide part or all of the foaming. Such components, that can form gas cither by reaction with the isocyanate or by utilizing heat generated by the chemical reactions in order to boil, are called blowing agents. Foams are microcellular structures, produced by gas bubbles formed during the polyurethane synthesis and the process of bubble formation is called blowing.

Other isocyanates can be pre- or in situ-polymerized, predominantly trimerized, to produce polyisocyanurate, also referred to as PIR, which when reacted with polyols, forming urethane linkages, produces a more rigid PUR-PIR foam. PUR-PIR foams are the more economical, and exhibit high strength to weight ratios. They can be made self-extinguishing and inherently have high insulation values. Their hydrophobic nature hinders mold habitation and their properties deteriorate very little with aging. Plastics on the whole are not biodegradeable, which is bad for pollution from one time use packaging etc., but is an asset in house construction.

Plastic shells with rigid foam cores presently are employed in marine, aviation and wind turbine applications to name a few where wood has been replaced or considered too inferior and undesirable for such applications. Exterior shells are frequently required to be hard and durable whilst the interior foam core is designed to be lightweight and help to distribute loads and stress. Presently such technology utilizing PUR-PIR foams is in the form of sandwich panels used almost exclusively for insulation.

The use of plastics in building construction and components is mentioned in the International Building Code 2018 Chapter 26. This chapter provides standards addressing foam plastic insulation, foam plastics used as interior finish and trim, and other plastic veneers used on the inside or outside of a building. It does not address the use of plastics for structural replacements for wood such as in floors. These would need to be engineered to meet or exceed the specifications based on what wood can provide for load bearing and deflection.

U.S. Pat. No. 4,903,446 to Richards describes using prestressed foam boards and blocks in construction by incorporating tensioned wires inside foams. A more recently published patent application, US 2004/0171710 to Mecchtle describes higher density rigid polyisocyanurate—Polyurethane (PIR-PUR) foams which reportedly achieve excellent compressive strength without prestressing.

A proposal to use a block and beam structure is disclosed in U.S. Pat. No. 5,353,560 to Heydon which utilized polystyrene insulation blocks between wooden I-beams. US 2010/0300037 Turner describes mimicking wooden I-beams with plastics and replace polystyrene with polyisocyanurate. U.S. Pat. No. 10,731,341 to Lambach describes load bearing or polyisocyanurate sandwich panels, for use as replacements for plywood boards, in floors but again with I-beams. These patents are more concerned with insulation of floors rather than replacing wood as the construction material.

SUMMARY OF THE INVENTION

This invention in one aspect provides for construction of raised floors that are in essence a continuous slab of rigid, insulating, loadbearing foam, constructed of abutting beams and interlaid blocks.

This invention utilizes polyisocyanurate rigid foam beams that can be assembled in parallel supported at each end, either on internal load bearing structures (concrete posts or steel poles traversed by a girder) and on the perimeter walls.

In another aspect of the invention sill plates formed of plastics are provided around both the perimeter foundations and also on the crawlspace or basement interior load bearing walls that support the raised floor. These sill plates accommodate plastic, creep resistant, header joists as a means to prevent lateral movement and provide a snug fit for the lightweight beams and blocks.

Also if interior loadbearing walls consisting of posts or concrete blocks are required, e.g., for longer spans that traditionally would require wooden beams these beams can be replaced with reinforced polyisocyanurate rigid foam filled plastic beams as described herein.

Voids between these beams can be infilled with architecturally designed, interlocking, lightweight polyisocyanurate blocks. Beams can be arranged to allow positioning of blocks so that the blocks can be bored or cut to accommodate infiltrating sewer pipes or other utility fixtures. If this flooring system is architecturally designed in conjunction with the footings and foundation, construction would be further simplified.

This invention also provides for a second layer of beams and blocks to further accommodate traversing, sub floor surface vents, piping and/or wiring.

In cases where additional load bearing is required, reinforced polyisocyanurate rigid foam filled plastic beams may be used.

The upper surface of the resulting continuous floor may be coated with a liquid sealant before installation of interlocking, staggered, plastic boards to complete the subfloor assembly. Alternatively the subfloor could be covered with a layer of concrete. These subfloor designs also would be receptive to floor finishes such as carpet, tiles and (imitation) hardwood as well as internal wall structures, wooden or otherwise.

DETAILED DESCRIPTION OF THE DRAWINGS

Further features and advantages of the present invention will be seen from the following detailed description, taken in conjunction with the accompanying drawings, wherein.

DETAILED DESCRIPTION OF THE INVENTION

For case of installation, no special design or adjusted positioning of loadbearing walls and foundations would be required from a conventional raised wooden floor. International Building Code compliant, construction.

Figure 1:
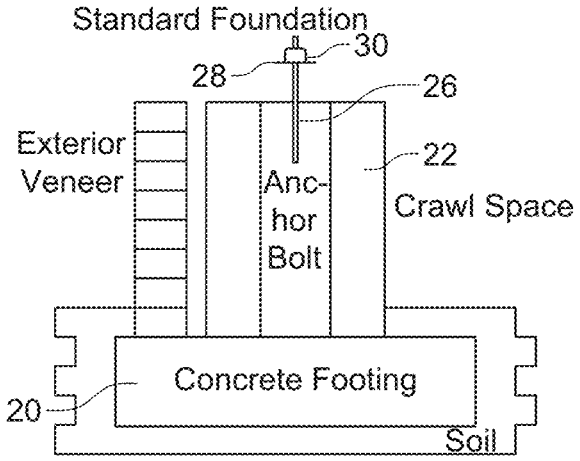
FIG. 1 (Prior Art)
FIG. 1 and FIG. 2 are cross sectional views showing respectively a standard foundation (FIG. 1) and a standard foundation with a wooden sill plate (FIG. 2)

Concrete footings and foundations prepared in accordance with the prior art conventional design usually contain anchor holts (meticulously) aligned ready for construction of the raised floor, a cross section as depicted in FIG. 1, and includes a concrete footing 20 and a pored wall 22.

Figure 2:
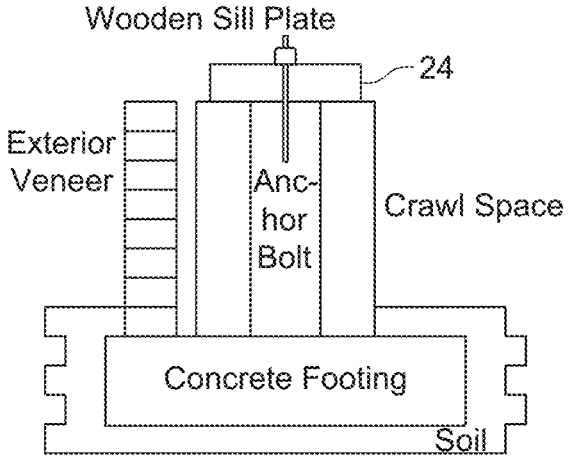
FIG. 2 (Prior Art)
Figure 3:
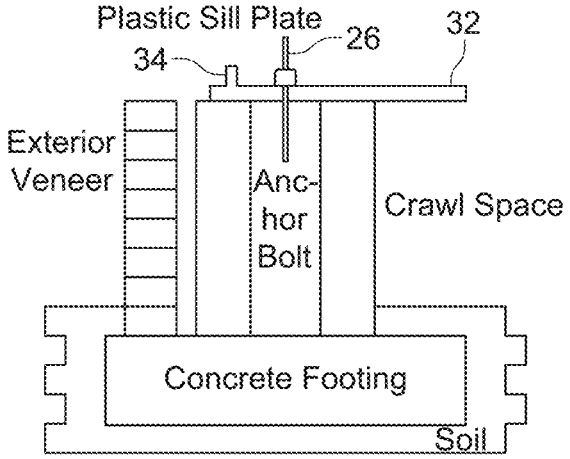
FIG. 3 is a cross sectional view showing a standard foundation with a plastic sill plate for an exterior wall in accordance with a first embodiment of the present invention.

Referring also to FIG. 2, for conventional wooden floors a sill or so-called sole plate in the form of a length of pressure treated dimensional lumber 24 is measured, bored to accommodate anchor bolts 26 and fixed in place by attaching a washer 28 and reattaching and tightening a nut 30. A similar process would be applied with the plastic sill plate 32, an embodiment of this invention, as depicted in FIG. 3. If the anchor bolts are aligned in a standardized format then the molded plastic sill plates could be produced with openings ready for accommodating the bolts significantly reducing installation time. Further a liquid sealant (not shown) could be applied prior to installation of the plastic sill plate for improved air seal over the somewhat rough concrete foundation surface.

As an alternative, metal anchor bolts 26 can be supplied already imbedded through the plastic sill plate so that the bolts and plastic sill plate can be fitted directly onto un-set freshly applied concrete foundation ready for further tightening when the concrete is set and the bolts securely set in the concrete foundation.

Figure 6:
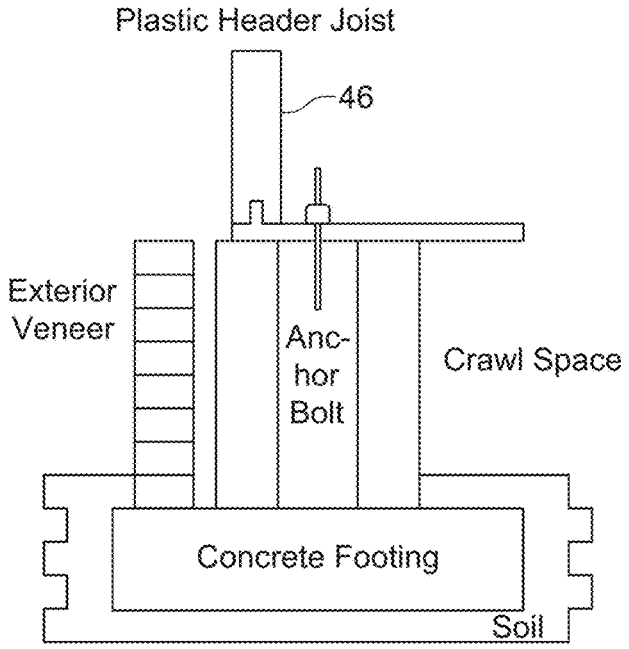
FIG. 6 is a view similar to FIG. 3 showing an exterior wall concrete footing in accordance with the present invention showing a plastic header attached to a plastic sill plate in accordance with the present invention.
Figure 7:
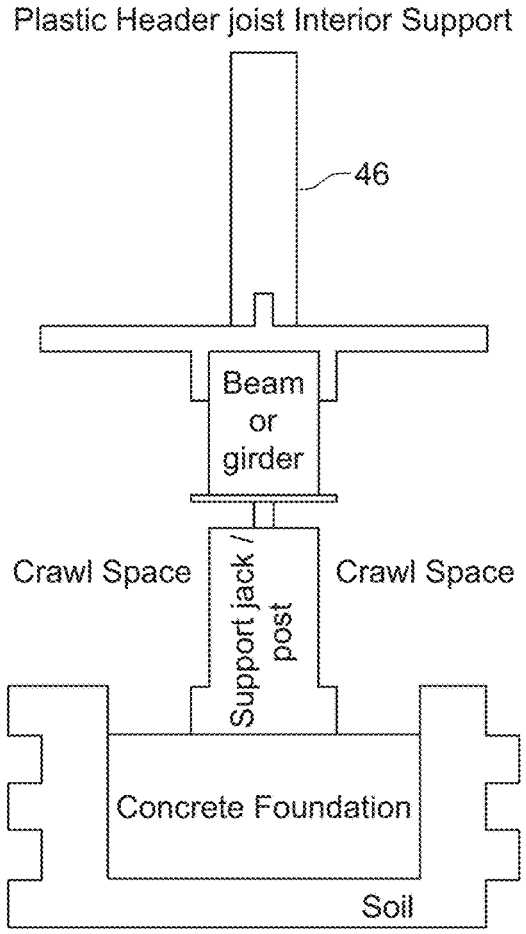
FIG. 7 is a view similar to FIG. 4 of an interior footer in accordance with the present invention, and showing an interior joist support fixed to a plastic sill plate in accordance with the present invention.

As can be seen in FIG. 3, plastic sill plates 32 in accordance with the present invention also include a tongue 34 preferably running to the length of the sill plate for engaging with a groove formed in and along a plastic header joist, as will be described below with reference to FIG. 6 and FIG. 7.

The sill plate of my invention is significantly different from dimensional lumber in structure and advantages. The sill plate has two important structural differences from conventional wooden sills in that it is wider extending beyond the foundation wall towards the interior of the building, and has an upstanding tongue 34 running along the exterior side of the perimeter wall foundation. The former of these differences facilitate subsequent installation and maneuvering of the plastic floor beams, and the latter supports the subsequent addition of an interlocking groove-containing plastic header joist as described below with reference to FIG. 6 and FIG. 7. These sill plates can be cut to facilitate perimeter wall angular junctions.

International Building Code compliant interior raised floor supports vary. For basements, the common method is to use steel support jacks or steel support posts. In crawl spaces, support jacks or concrete posts could be used, constructed on appropriate foundations. In both cases they can be spanned on lop by beams or girders. If they are intended to be spanned by a wooden beam, it can be replaced by reinforced polyisocyanurate rigid foam filled plastic beams in accordance with the present invention.

Figure 4:
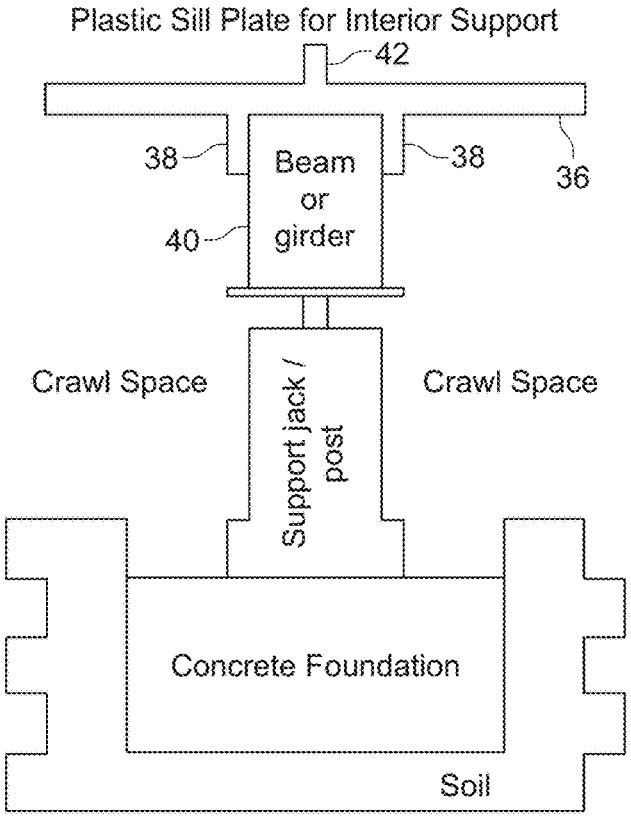
FIG. 4 is a view similar to FIG. 3 showing a plastic sill plate in accordance with a second embodiment of the present invention as a support on an internal load bearing wall.

Referring to FIG. 4, a special plastic sill plate 36 is placed on the support beam of the aforementioned steel support jacks or concrete posts, a cross section of which is depicted in FIG. 4. As can be seen in FIG. 4, plastic sill plate 36 includes a pair of downwardly direction tongues 38 for straddling a support beam or girder 40, and an upwardly directed tongue 42 for mating with a groove in a plastic header joist 46.

Figure 5:
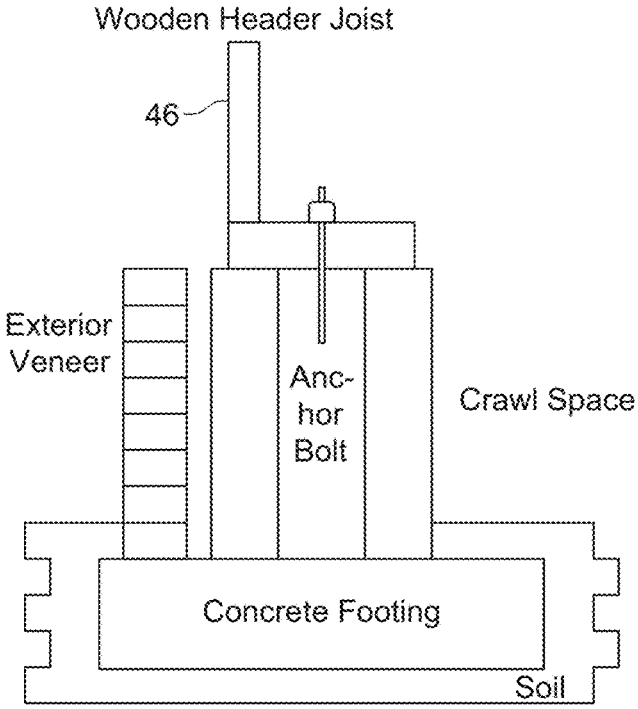
FIG. 5 (Prior Art)
FIG. 5 is cross sectional view of a prior art conventional footing showing a header joint toe nailed to a wooden sill plate.

In conventional wooded framed raised floors, header joists 44 are toe-nailed to the wooden sill plate a cross section of the resulting structure is depicted in FIG. 5.

Conversely in my invention plastic header joists 46 are adhesively attached to the plastic sill plates along their length via a tongue 34 and groove 46. A cross section of these are depicted in FIG. 6 and FIG. 7.

Figure 8:
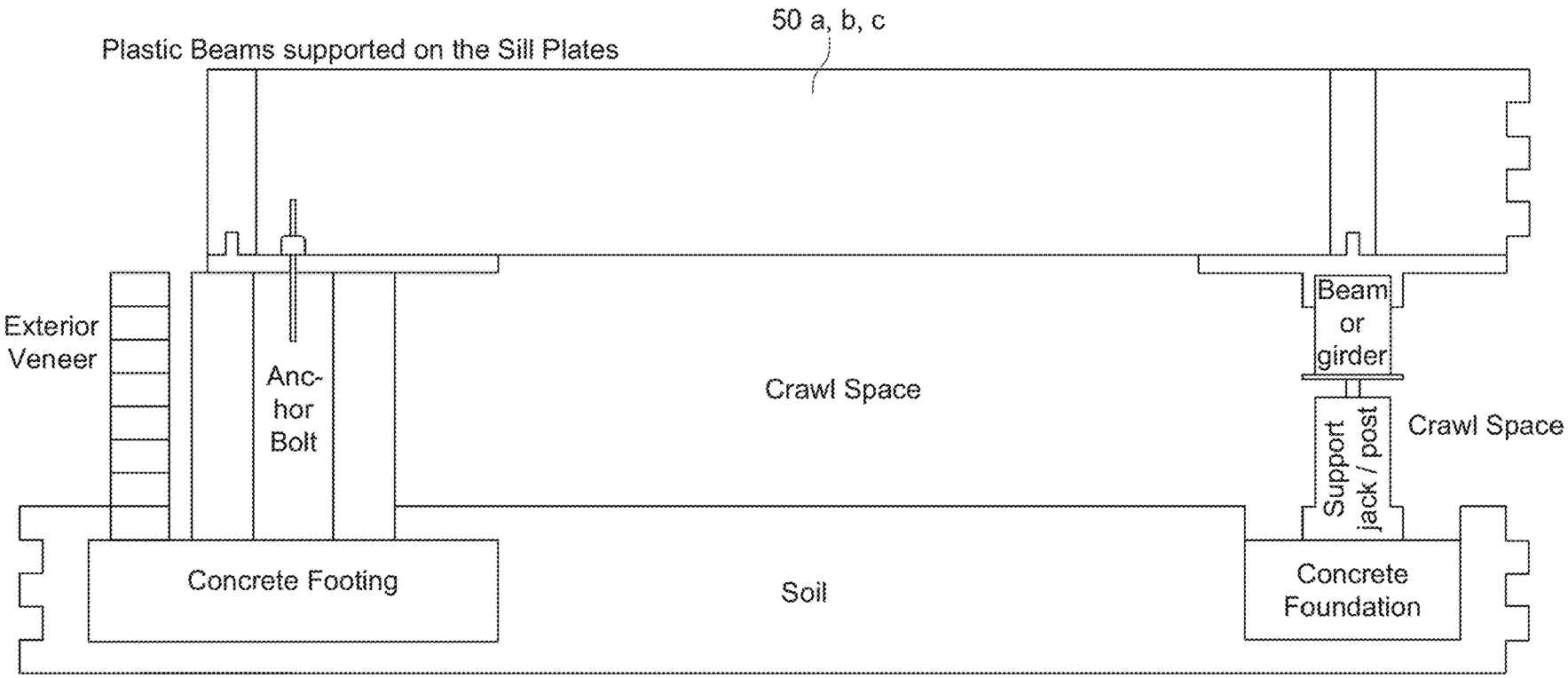
FIG. 8 is a cross sectional view showing a beam laid on plastic sill plates in accordance with the present invention.
Figure 9:
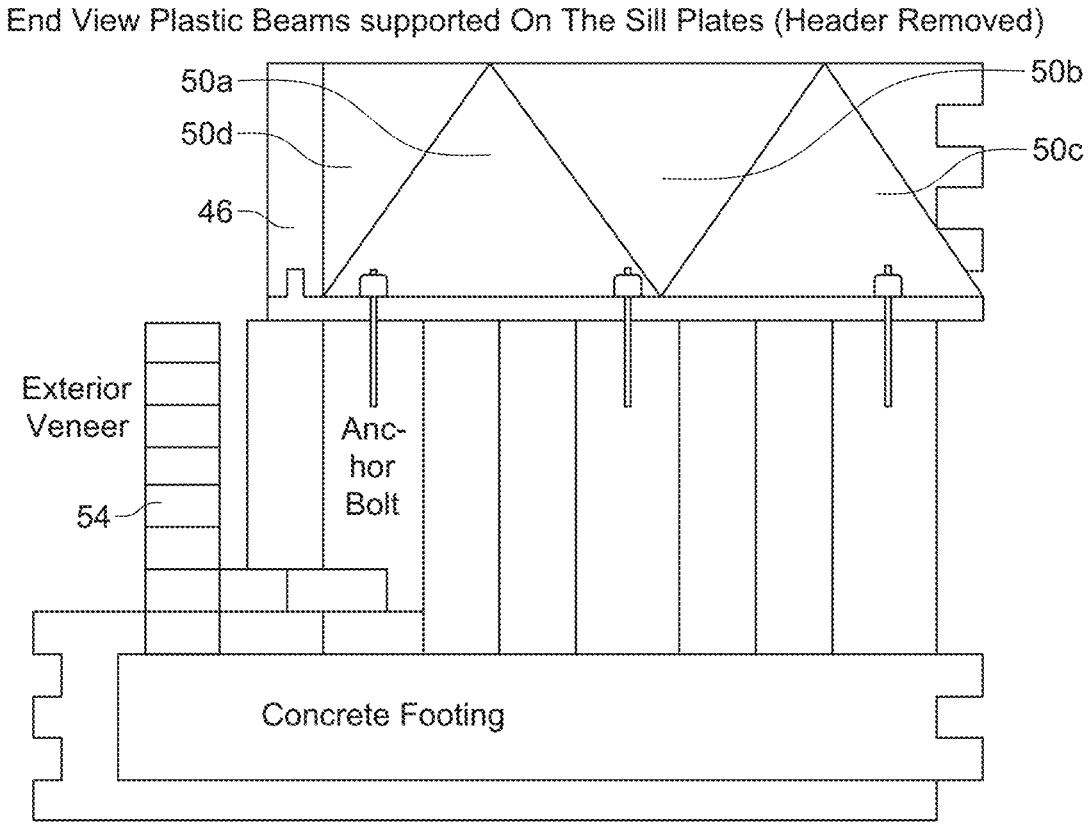
FIG. 9 is an end view showing beams supported on sill plate in accordance with the present invention.

In another embodiment the present invention provides a beam and block flooring formed of plastic sub floor materials. Referring to FIG. 9, a beam and block plastic sub floor is formed of triangular cross sectioned beams 50*a, b, c* made of Polyisocyanurate (PUR-PIR) which are laid on the sill plates abutting the header joists. Beams 50*a* and 50*c* are placed parallel to each other and touching. Another beam 50*b* is then placed in the v shaped space formed between these beams. The beams 50*a, b, c* are lengthwise depicted in FIG. 8.

FIG. 9 depicts the beams endwise (with the Exterior Veneer 54 reduced and plastic header joist abutting the ends not shown—exposing the anchor bolts 26). As can be seen in FIG. 9, a half beam 50*d* is dropped into the gap between the first triangular beam and the header joist 46. In the simplest instance where there are no sewer, vent or water pipes traversing the raised floor section or no ductwork or other intrusion to the subfloor, then these triangular beams can continue in this pattern from header joist to header joist whereby another half beam will be placed in the mirror image of the other end of the raised floor construct ion. To guarantee a snug fit a rectangular filler joist may be provided and or rigid spray foam may be used to fill any remaining small channel between the beam arrangement and the header joist.

Figure 10:
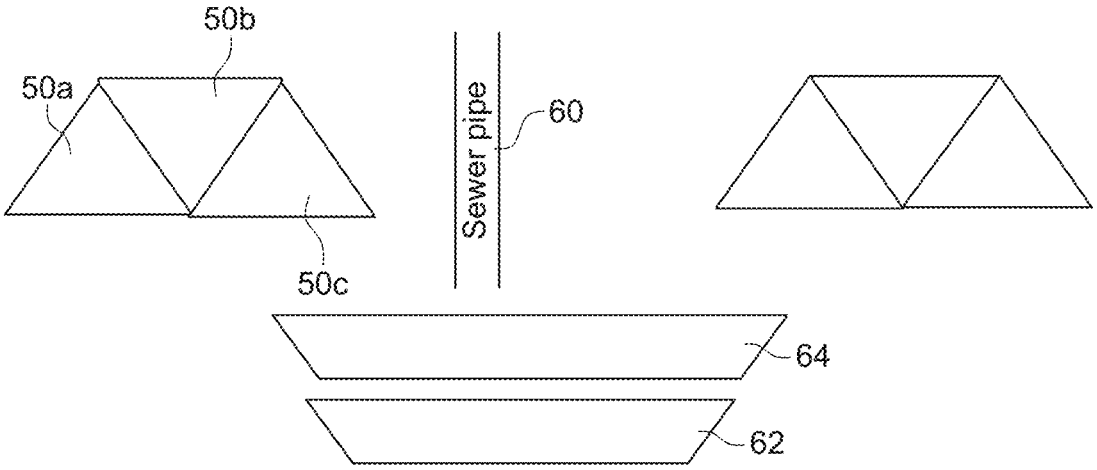
FIG. 10 is an exploded view of plastic beams and plastic blocks ready for accommodating a sewer pipe in accordance with the present invention.

Referring to FIG. 10, where elements as a sewer, vent or water pipes 60 need to pass through the raised floor, a gap may be left between the parallel floor beams. This gap will then be infilled with trapezoidal shaped blocks from a header joist up to the sewer pipe or other traversing element. These blocks consist of a lower block 62 and an upper block 64. A cross section taken perpendicular to the beams across the sewer pipe is depicted in FIG. 10. Also shown are the lower block 62 and upper block 64 that fit into the void between beams.

Figure 11:
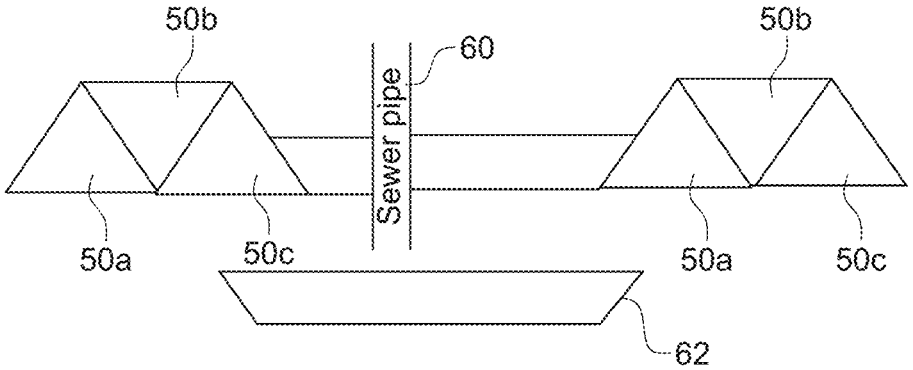
FIG. 11 is an exploded view similar to FIG. 10, at an intermediate stage in accordance with the present invention.

The next lower block 62 is measured and bored to fit over the pipe 60 and to butt up against the adjacent block and be supported by the beams. This is depicted in FIG. 11.

Figure 12:
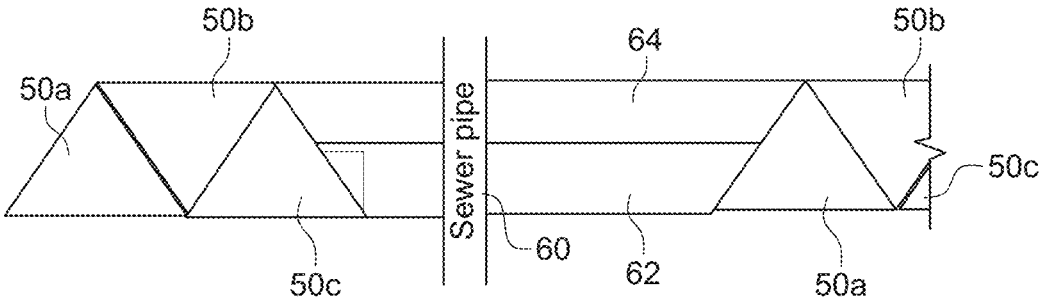
FIG. 12 is a cross sectional view showing a floor beam with lower and upper blocks placed around a sewer pipe in accordance with the present invention.
Figure 13:
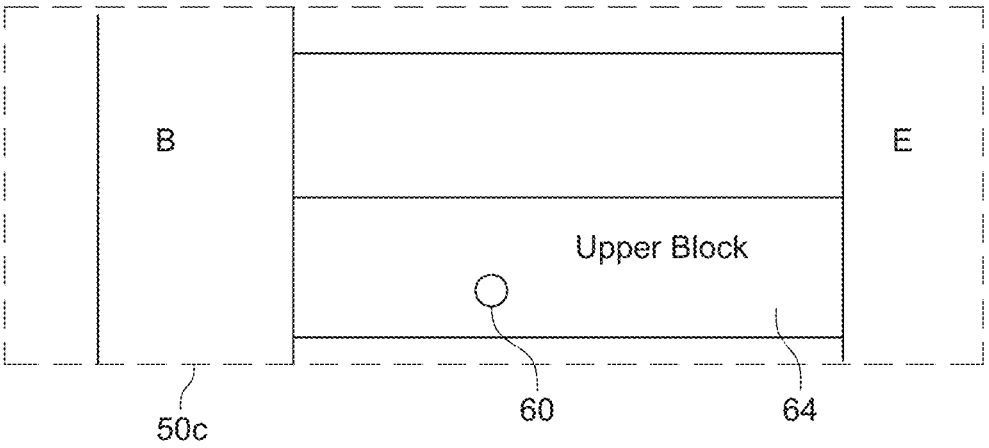
FIG. 13 is a top plan view of a floor in accordance with the FIG. 12 embodiment.

FIG. 12 depicts a cross section of the floor with both the lower and upper blocks 62, 64 measured, bored and placed around the pipe and resting on beams 50*a* and 50*c*. The upper and lower blocks 62 and 64, should overlap to assist in providing an airtight seal. FIG. 13 depicts the view from above. Similarly this arrangement of blocks will continue up to the header joist. These blocks can be cut to provide snug fit against the header joist.

Figure 14:
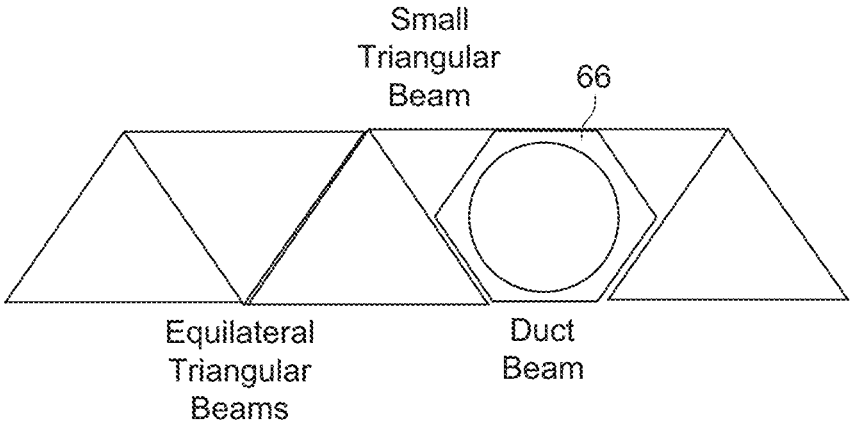
FIG. 14 is a cross sectional view of a floor structure in accordance with the present invention having HVAC (heating and cooling ducts) incorporated into the floor structure.
Figure 15:
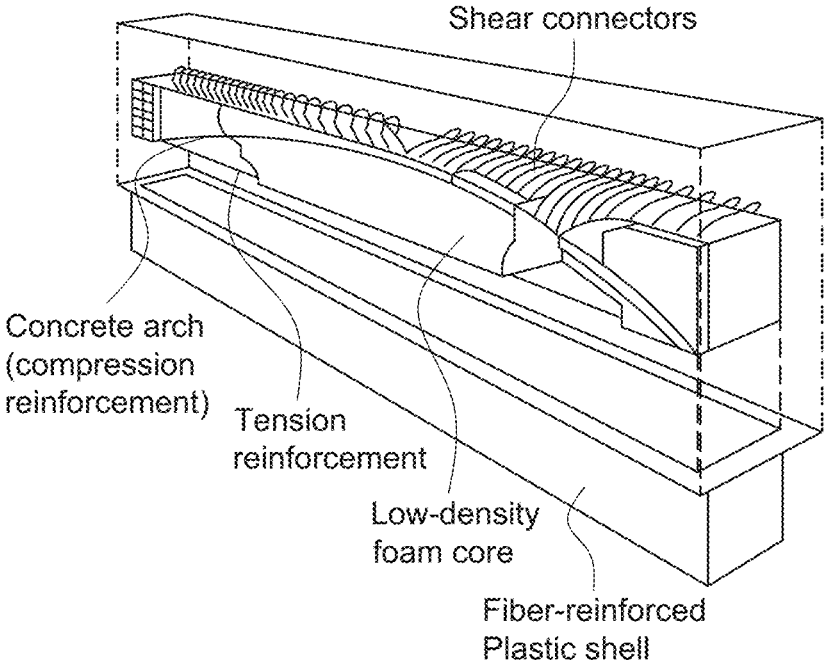
FIG. 15 (Prior Art)
FIG. 15 is a perspective view showing a plastic beam constructed in accordance with the prior art.

Heating and cooling ducts 66 also may be incorporated into this insulating foam floor structure supported by the two adjacent regular triangular beams; a cross section of which is depicted in FIG. 14. The duct beam can be provided in modular interconnecting pieces. Also junction pieces can be provided to transfer air flow up or down or to connect with transverse ducts in a second foam structure layer. When using hexagonal shaped beams or beam ducts smaller triangular beams may be inserted to fill the voids.

A second, thinner plastic layer of beams and blocks can be provided over the first (load bearing) layer mainly to distribute ducts in transverse direction to those in the first layer. A load bearing plastic beam can be constructed along lines of such bridge beam as described in U.S. Pat. No. 6,145,270A to Hillman with the main exception that the concrete arch would be replaced with plastic.

The wood-free raised floor structure of this invention has several advantages over convention wooden flooring. This plastic floor structure is ideal for installation over crawl spaces and can be utilized as basement ceiling/ground level floor. It does not require vapor barriers or moisture barriers as the material itself is hydrophobic and akin to the plastics already used in such barriers. It docs not require extra sprayed on or batting insulation as it inherently possesses excellent energy saving insulation properties. The material needs no treating for protection against mold termites or other vermin. It is permanent—no rot or biodegradation. It requires very little fastening and is lightweight, easy to handle and install even in inclement weather. These beams and blocks can easily be cut and bored to accommodate building exterior wall design and internal utilities. The plastic structure also is an excellent consumer of recycled plastics. Further, the floor structures formed of polyisocyanurate are not significant fire hazards, since polyisocyanurate can be made to be self-extinguishing as soon as the source of ignition is no longer present.

Figure 16A:
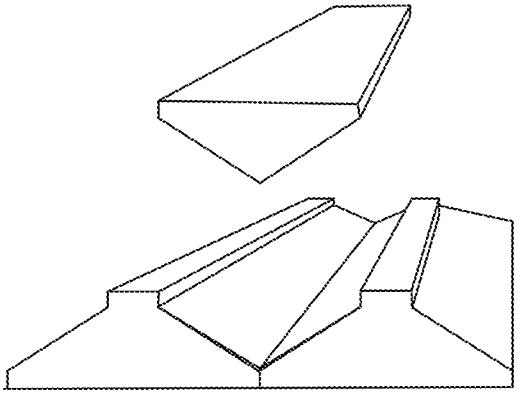
FIGS. 16A, 16B and 16C are exploded perspective views illustrating yet other shapes, which are given as exemplary.
Figure 16B:
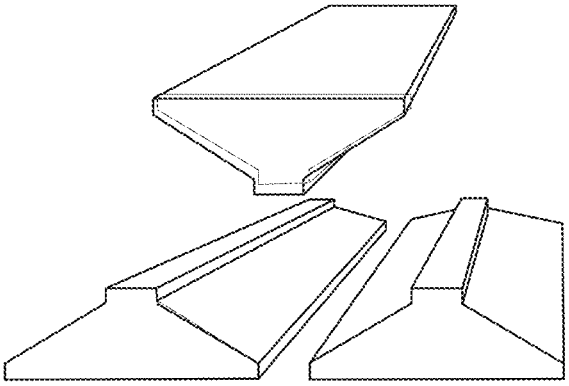
Figure 16C:
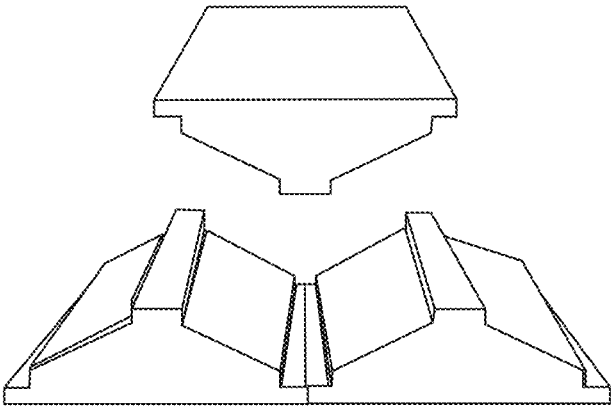

Various changes may be made without departing from the spirit and scope of the invention. By way of example, while the elongated beams are illustrated as being essentially triangular in cross-section, the beams need not be completely triangular in cross section. (See FIGS. 16A, 16B, 16C). Other shapes are possible provided they are still interlocking to form a complete block for the floor. In like, manner, the blocks, while illustrated as being essentially trapezoidal in cross-section, may take other shapes provided they interlock with the beams.

The invention claimed is:

1. A building sub-floor construction comprising a plurality of elongated beams formed of rigid polymer foam material, wherein the elongated beams comprise similar cross-sectional shapes, and wherein the elongated beams are configured to snuggly engage one another along their lengths to produce a continuous slab, and wherein one or more of said plurality of elongated beams is hollow and configured to function as an air duct, and wherein the construction further includes header joists on sill plates around a perimeter of the sub-floor providing a snug fit for said beams.

2. The building sub-floor construction of claim 1, further comprising trapezoid shaped blocks formed of rigid polymer foam material inserted between and supported by the elongated beams.

3. The building sub-floor construction of claim 2, wherein the blocks are formed of PUR/PIR (polyurethane/polyisocyanurate) foam.

4. The building sub-floor construction of claim 2, wherein the blocks are coated or encased in plastic material.

5. The building sub-floor construction of claim 1, wherein the elongated beams have triangular cross sections, wherein a first and a third beam have edges aligned and in contact with one another forming a V-shaped opening, and wherein a second triangular shaped beam is positioned in the V-shaped opening formed between the first and the third beams.

6. The building sub-floor construction of claim 1, wherein the beams are formed of rigid PUR/PIR (polyurethane/polyisocyanurate) foam.

7. The building sub-floor construction of claim 1, wherein the beams are coated or encased in a plastic material.

8. The building sub-floor construction of claim 1, wherein the beams are reinforced.

9. The building sub-floor construction of claim 1, wherein the one or more beams configured to function as an air duct are hexagonal shaped beams.

* * * * *